US006006505A

United States Patent [19]

Natterer

[11] Patent Number: 6,006,505

[45] Date of Patent: Dec. 28, 1999

[54] LIFTING DEVICE FOR A WORKING STATION OF A PACKAGING MACHINE

[75] Inventor: Johann Natterer, Legau, Germany

[73] Assignee: Multivac Sepp Haggenmuller GmbH & Co., Wolfertschwenden, Germany

[21] Appl. No.: 09/126,474

[22] Filed: Jul. 30, 1998

[30] Foreign Application Priority Data

Aug. 8, 1997 [EP] European Pat. Off. ..... 97113794

[51] Int. Cl.[6] ..... B65B 31/02; B65B 65/02

[52] U.S. Cl. ..... 53/559; 53/75; 53/374.8; 53/375.6

[58] Field of Search ..... 53/559, 374.8, 53/375.6, 373.7, 373.5, 373.4, 478, 75; 493/209, 372

[56] References Cited

U.S. PATENT DOCUMENTS

| | | | |
|---|---|---|---|
| 3,958,394 | 5/1976 | Mahaffy et al. | 53/559 X |
| 4,033,092 | 7/1977 | Vetter | 53/131.5 X |
| 5,540,802 | 7/1996 | Totani | 53/75 X |
| 5,551,206 | 9/1996 | Fukuda | 53/75 |
| 5,653,085 | 8/1997 | Suga | 53/374.5 X |

FOREIGN PATENT DOCUMENTS

| | | |
|---|---|---|
| 0 569 937 A1 | 11/1993 | European Pat. Off. . |
| 24 37 124 A1 | 2/1976 | Germany . |
| 42 16 207 C1 | 8/1993 | Germany . |
| 8-217007 | 8/1996 | Japan . |

*Primary Examiner*—James F. Coan
*Attorney, Agent, or Firm*—George W. Neuner

[57] ABSTRACT

The invention provides a lifting device for a working station of a packaging machine, the working station comprising a first tool member and a second tool member mounted for movement relative to the first tool member. The lifting device comprises a first lifting member for producing a first closing travel of the second tool member towards the first tool member and a second lifting member for producing a second closing travel following said first closing travel. The second lifting member comprises drive means and mechanical transmission means having means for producing substantially constant closing force for the second closing travel upon occurrence of a resistance. The mechanical transmission means preferably comprises rollers mounted between three planes, whereby the lifting movement for the second closing travel is produced by moving the first plane from a first position into a second position by means of the drive means, thereby displacing the rollers between the second and the third plane such that the distance between the second and third plane is enlarged.

18 Claims, 8 Drawing Sheets

LIFTING DEVICE FOR A WORKING STATION OF A PACKAGING MACHINE

BACKGROUND OF THE INVENTION

The invention relates to a lifting device for a working station of a packaging machine, the working station having a first tool member and a second tool member mounted for movement relative to the first tool member.

A packaging machine conventionally comprises working stations for various operations such as forming, filling, sealing and cutting. A lifting device moves at least a movable member of a working station into its operating position. In this position an enhanced closing force for closing the tool members of the working station is required to lock a packaging web for carrying out the operation. For example, a chamber is hermetically closed for molding a portion of a plastic sheet material and thereafter the sheet material is molded using fluid from a pressurized air source. The high pressures used for a fast and exact molding operation put a high load on the forming station.

In order to receive this high load in the closed state of the working station it is necessary to have closing members producing a closing force which is greater than the load imposed during the operational phase. Simple members consist of piston-cylinder devices having a correspondingly large effective area. However, such members are very expensive because of their high air consumption for the entire lifting stroke. Other members consist of toggle lever systems producing higher forces at the end of the travel by mechanical transmission. It is a drawback of such toggle lever systems that they produce a defined closing movement having a so-called dead point. Thus, close tolerances must be observed on the one hand for generating the required closing force at the dead point and on the other hand the forces are varying dependent on the thickness of the web material. However, the thickness of the material depends on the intended use and may therefore vary within wide limits. Hence, the adjustment of the lifting device must be adapted after each change of the thickness of the material. This demands a lot of the operator.

German patent application 42 16 207 discloses a lifting device for a cutting station of a packaging machine. The lifting device comprises a piston-cylinder device with a piston rod being adapted to form an abutment at its free end. At the end of a lifting travel produced by the piston-cylinder device the piston rod is further lifted by pushing a wedge-shaped member into a corresponding recess of the piston rod to produce, in the final position thus obtained, a force which is higher than the force which can be produced by the piston-cylinder device. However, the friction forces occurring by pushing in the wedge cause a rapid wear of material.

OBJECTS OF THE INVENTION

It is an object of the invention to provide an improved lifting device for a working station of a packaging machine. It is a further object to provide a lifting device for a working station of a packaging machine which operates independent of the thickness of the packaging material, requires no adjustment and has low demands on tolerances.

SUMMARY OF THE INVENTION

In order to achieve the above-mentioned objects the invention provides a lifting device for a working station of a packaging machine, the working station having a first tool member and a second tool member mounted for movement relative to the first tool member, the lifting device comprising a first lifting member for producing a first closing travel of the second tool member towards the first tool member, and a second lifting member for producing a second closing travel following the first closing travel, the second lifting member comprising drive means and mechanical transmission means having means for producing a substantially constant closing force for the second closing travel upon occurrence of a resistance.

Thus, the working station is closed in two steps: the first closing travel into the working position is a longer travel and requires a relatively low force. The force required for the working operation is thereafter produced by a second closing travel receiving the effective forces acting in the operational process. A power lifting member produces the force required for the second closing travel independent of the means effecting the first closing travel. The required force is always produced at the end of the closing travel, irrespective of an exact dead point. It is a further advantage of the lifting device that the power lifting member for producing the second closing travel is designed in a compact and space-saving manner and exhibits a high wear resistance.

BRIEF DESCRIPTION OF THE DRAWINGS

Further advantages, features and objects of the invention will be apparent from the following description of an embodiment with reference to the drawings. In the drawings:

FIG. 7*a*) tool members in position "open",

DESCRIPTION OF THE PREFERRED EMBODIMENT

Figure 1:
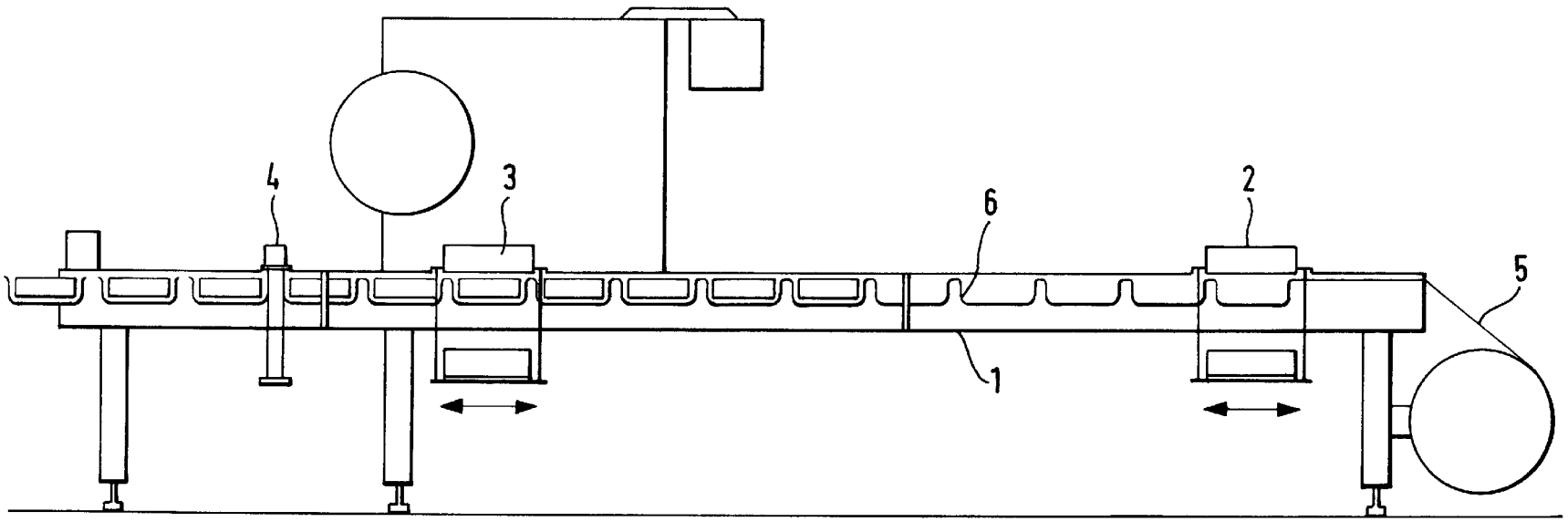
FIG. 1 is a side view of a packaging machine, the lateral covering being omitted.

As depicted in FIG. 1 the packaging machine comprises a machine frame 1 and a forming station 2, an evacuating and sealing station 3 and a cutting station 4 arranged successively thereon. In the packaging machine a film sheet 5 is fed to the inlet side of the machine. In the forming station the film sheet is molded to form containers 6. After filling the containers in a filling station (not shown in the figure) the containers are sealed in the evacuating and sealing station 3 using a cover film and finally separated from each other using the cutting device 4. The machine frame 1 also comprises the guiding device for a chain drive (not shown) for transporting the film sheet 5 and the containers 6 molded therein, resp.

As best shown in the FIGS. 2 to 5 a working station, shown in an exemplary manner as evacuating and sealing station 3, comprises a base 7, an upper tool member 8 rigidly mounted to the base and a lower tool member 9 mounted for movement relative to the upper tool member. The base 7 and the upper tool member 8 of the working station are interconnected by means of guide rods 10.

Figure 2:
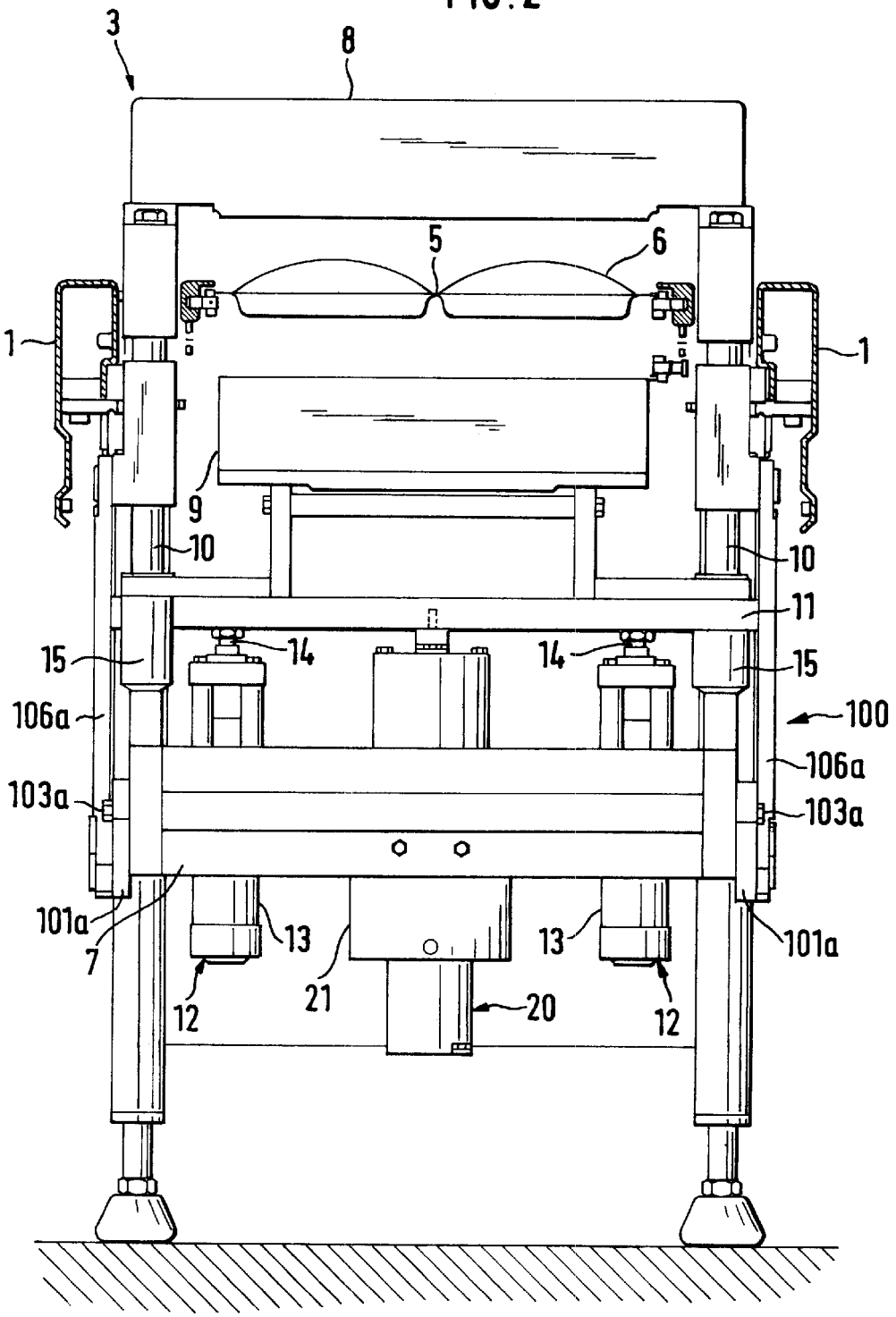
FIG. 2 is a longitudinal view of a working station in transport direction of the package, in open state.
Figure 3:
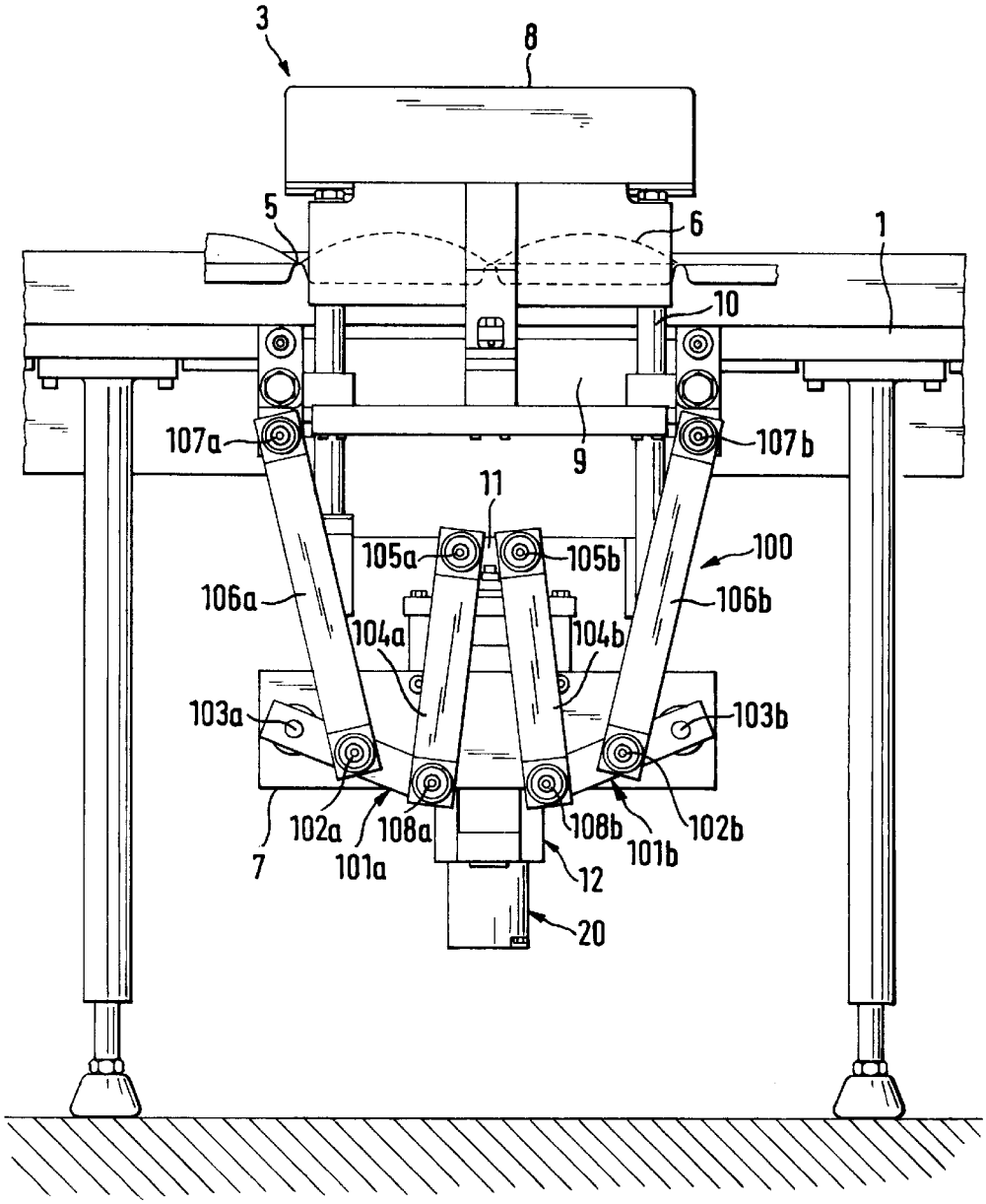
FIG. 3 is a side view of the working station of FIG. 2 in a direction perpendicular to the transport direction of the packages.
Figure 4:
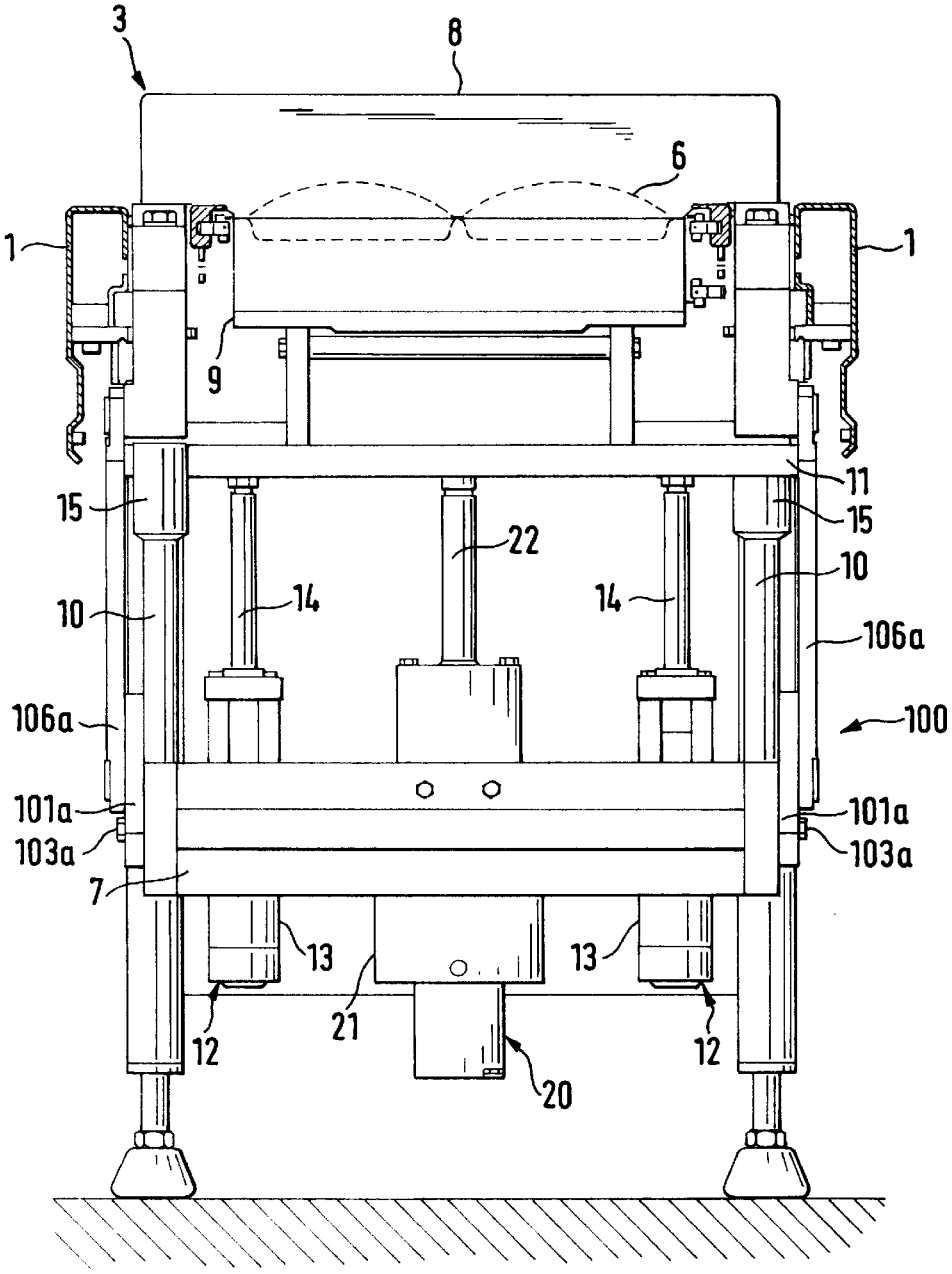
FIG. 4 is a longitudinal view of the working station in transport direction, as in FIG. 2, in closed state.
Figure 5:
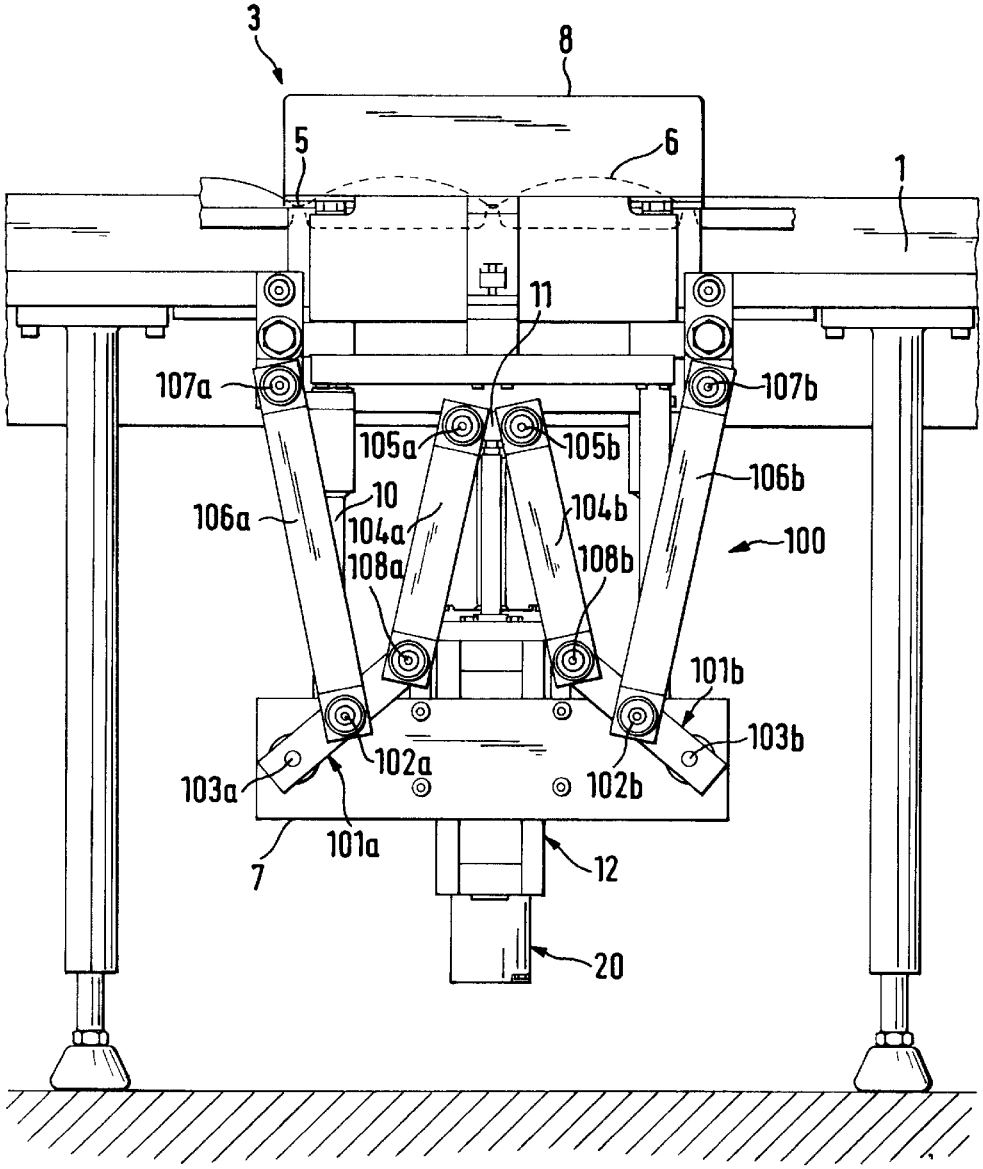
FIG. 5 is a side view of the working station perpendicular to the transport direction, as in FIG. 4.

A lifting device is provided for moving the lower tool member 9 relative to the upper tool member 8 from an open position shown in the FIGS. 2 and 3 into a closed position shown in FIGS. 4 and 5, whereby the lower tool member 9 cooperates with the upper tool member 8 in the closed position. The lifting device comprises two piston-cylinder devices 12 connected with each other through a cross-piece 11. The cylinders 13 of each piston-cylinder device 12 are each connected to the base 7, whereas the piston rods 14 are each connected to the cross piece 11 which carries the lower tool member 9. The cross piece 11 and the lower tool member 9 connected thereto are provided with guide sleeves 15 sliding along the guide rods 10.

The piston-cylinder devices 12 are constructed to move the lower tool member 9 from the open position into the closed position and vice versa over a long lift stroke in the order of up to above 200 mm in a first closing travel.

In order to receive the effective forces produced by the working process in closed position of the working station the lifting device comprises a second lifting member, a so-called power lifting member 20, for producing a closing force over a second closing travel having a lifting stroke which is smaller than that of the first closing travel. The power lifting member 20 comprises a housing 21 which is rigidly mounted to the base 7 and a movable member formed as a lifting rod 22 which is displaceable within the housing 21 in lifting direction. The end of the lifting rod 22 facing the lower tool member 9 is secured to the cross-piece 11 and thus rigidly connected to the lower tool member 9.

As in particular shown in the FIGS. 6 and 7*a* to 7*e* the power lifting member 20 comprises a drive formed as a piston-cylinder device 23 having a cylinder axis or center axis M aligned parallel to the lifting direction of the lower tool member 9. The piston-cylinder device 23 comprises a cylinder 24 and a piston 25 displaceable therein. The cylinder 24 has an opening 27 provided at its face 26 facing the lower tool member 9. The lifting rod 22 extends through the opening 27 and is displaceably supported therein by friction bearings and sealed by means of seals 28 with respect to the cylinder chamber. The piston 25 has a corresponding opening 29 and the lifting rod 22 extends through this opening. A piston rod connected to the piston 25 is formed as a sleeve 30 which slidably receives the lifting rod 22 extending therethrough and supported therein by friction bearings. The piston-cylinder device 23 further comprises an inlet 31 and an outlet 32 for supplying and exhausting, resp., pressurized air to and from the cylinder chamber.

The piston-cylinder device 23 is connected to a housing 21 of the power lifting member 20 housing the mechanical force transmitting members described further below. The housing 21 has a top side 40 facing the lower tool member 9 and contiguous with the side of the piston-cylinder device 23 opposite to the face 26. The sleeve 30 as well as the lifting rod 22 passing through the sleeve displaceably extend through an opening 41 in the top side 40 of the housing 21. The housing 21 has a rectangular cross-section in a plane perpendicular to the center axis M and sidewalls forming a chamber 50 housing the mechanical force transmitting members. The bottom side 51 of the housing 21 has an opening 52 communicating the chamber 50 with a second chamber 53 of reduced cross-section. As in particular shown in FIG. 7*a* the second chamber 53 entirely receives the free end 60 of the lifting rod 22 in open position of the working station.

Figure 6:
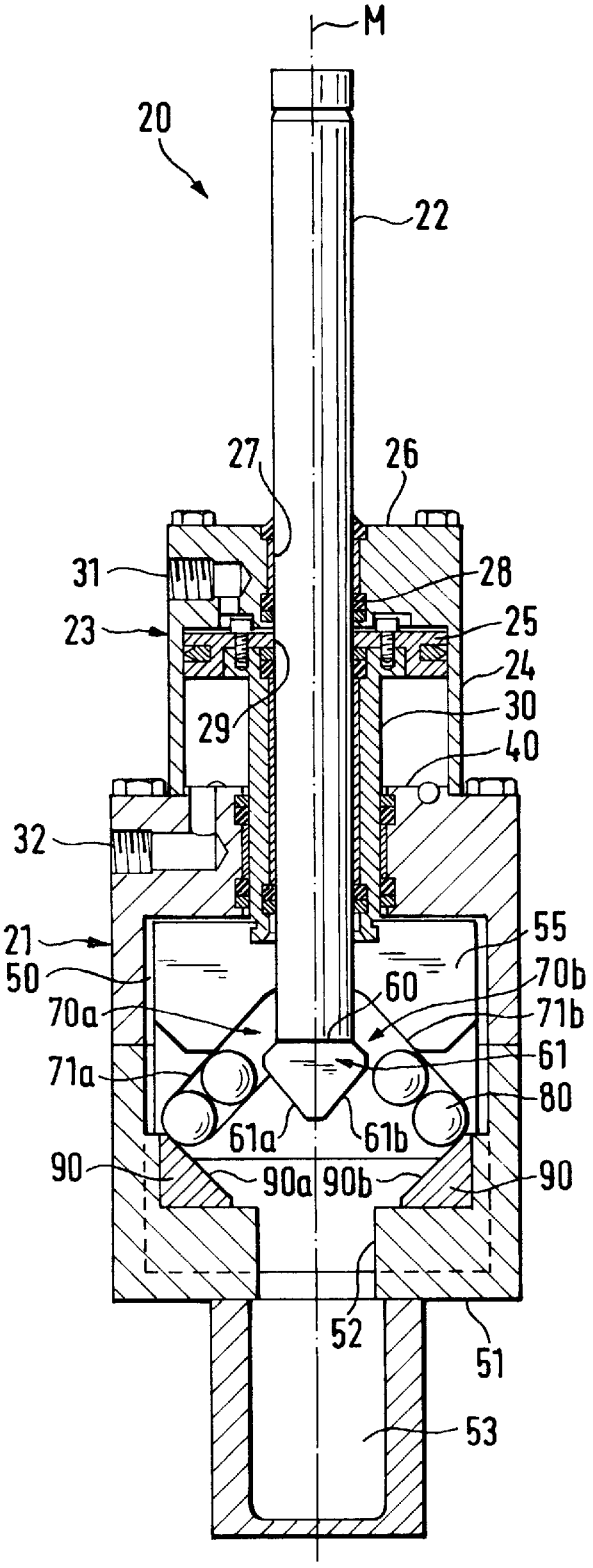
FIG. 6 shows a section of an inventive power lifting member.

The free end 60 of the lifting rod 22 comprises an end piece or thrust member 61 shaped substantially as an inverted gable of a roof and having therefore, as in particular shown in FIG. 6, a triangular cross-section in a plane parallel to the center axis M. The thrust member 61 therefore comprises two plane surfaces 61*a*, 61*b* each including an acute angle with the center axis M.

Figure 7E:
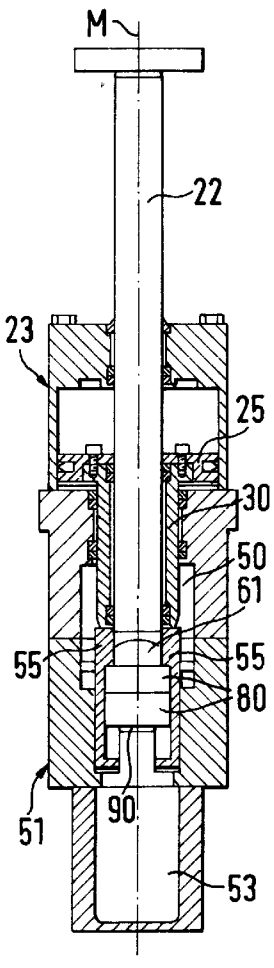
FIG. 7*a*) to FIG. 7*e*) are sectional views of the inventive power lifting member shown in FIG. 6 in four phases of the lifting operation.
FIG. 7*b*) tool members in position "closed", end of the first closing travel, FIG. 7*c*) start of the second closing travel by starting the power lift, FIG. 7*d*) end of the second closing travel, FIG. 7*e*) a side view of the power lifting member according to FIG. 7*d*) in sectional representation, FIG. 8*a*) to FIG. 8*c*) schematic representations of one side of the cooperating elements of the power lifting member according to FIG. 6, corresponding to the positions in FIGS. 7*b*), 7*c*) and 7*d*).

The chamber 50 houses a gate-type link 55 for displacement therein between the top and bottom side of the chamber 50. An upper end of the gate-type link 55 facing the piston-cylinder device is rigidly secured to the sleeve 30. As shown in FIG. 7*e* the gate-type link is formed of two parts and has, as shown in particular in the FIGS. 6 and 7*a* to 7*d*, two guide grooves 70*a*, 70*b* at each surface thereof facing the interior of the chamber. The ends of pairs of rollers 80 extending transversely through the chamber 50 are each guidably received in the guide grooves 70*a*, 70*b*. Hence, four rollers 80 are provided in total. The guide grooves 70*a*, 70*b* both extend in a direction including an obtuse angle with the center axis M. The rollers 80 are movable with a restricted guidance along the guide grooves.

The upper longitudinal edges of the opposite guide grooves 70*a* corresponding to a pair of rollers define a first plane 71*a* of force transmission from the gate-type link 55 to this pair of rollers, the plane extending at an obtuse angle with respect to the center axis M. Owing to the symmetric design of the gate-type link 55 with respect to the center axis M the same applies to the upper longitudinal edges of the other pair of rollers which define a corresponding first plane 71*b*.

Figure 8C:
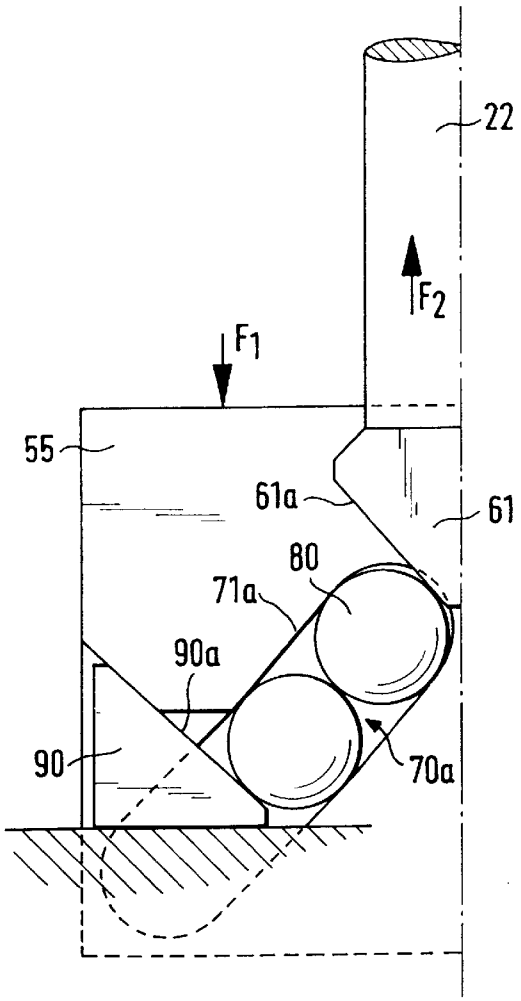
Figure 8B:
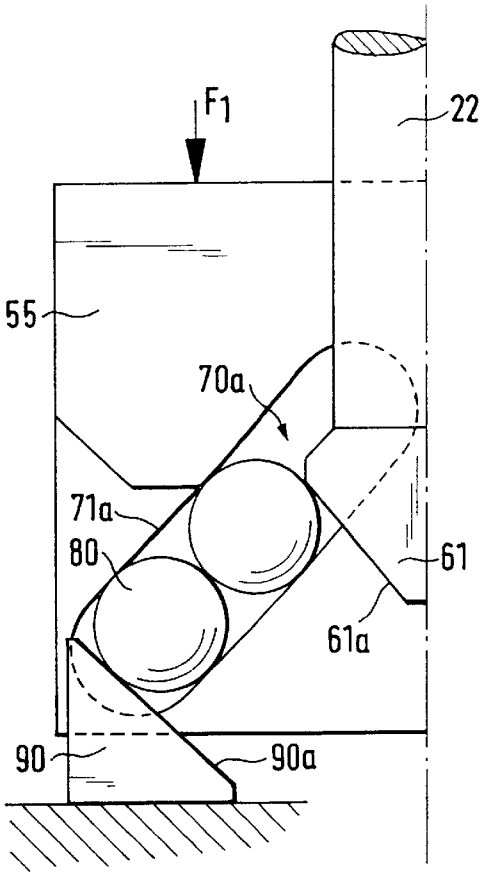
Figure 8A:
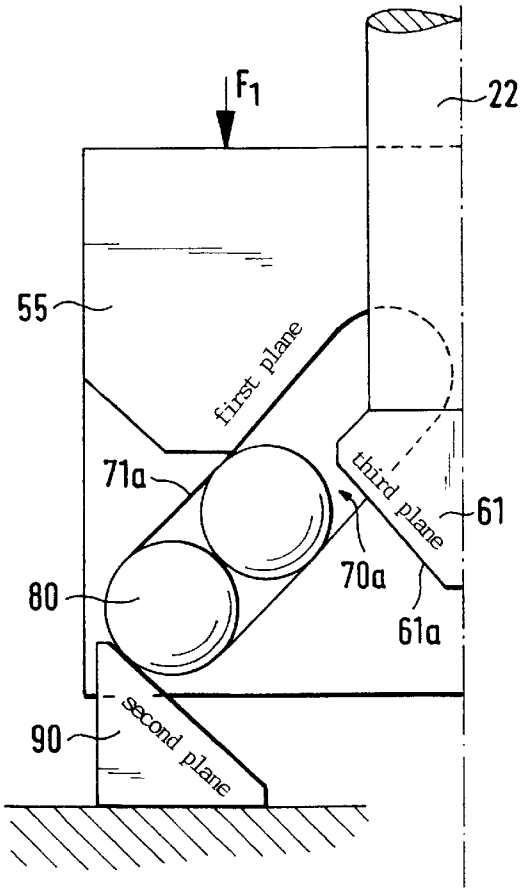

An abutment 90 for the rollers 80 is provided at a distance from the bottom of the housing 21. The abutment 90 is symmetric and has two surfaces 90*a*, 90*b* each including an acute angle with the center axis and supporting a corresponding pair of rollers 80. The angle between the surfaces 90*a*, 90*b* and the center axis M differs from the angle between the surfaces 61*a*, 61*b* of the end piece and the center axis M in such a manner that a second plane extending along the surface 90*a* is slightly inclined with respect to a third plane extending along the surface 61*a* so that both planes include a wedge angle. The same applies to the surfaces 90*b* and 61*b*. As best shown in FIGS. 8*a* to 8*c* the first plane is substantially perpendicular to the second plane.

The relative inclination angle of the three planes determines the force transmission ratio of the force $F_1$ exerted by the piston-cylinder device 23 and the force $F_2$ acting through the lifting rod 22 onto the lower tool member 9 during the second closing travel. Hence, the mechanical force transmission device is designed to exert a substantially constant force, whereby the force for the second closing travel is produced upon occurrence of a resistance.

Figure 7D:
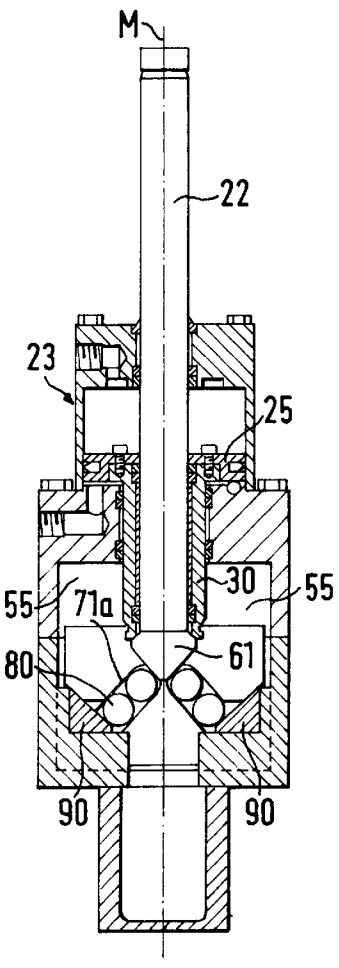
Figure 7C:
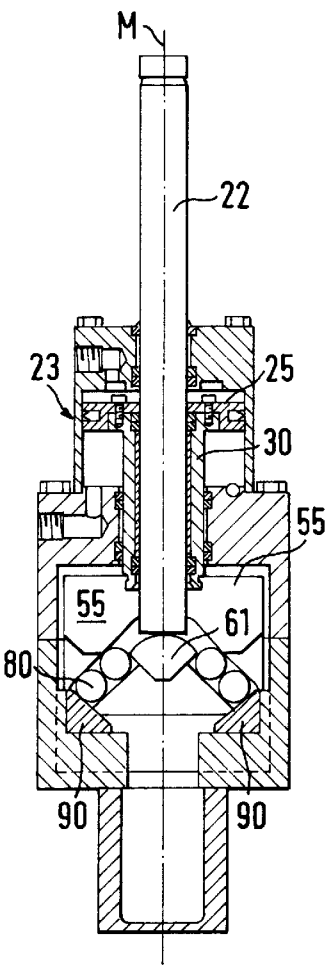
Figure 7B:
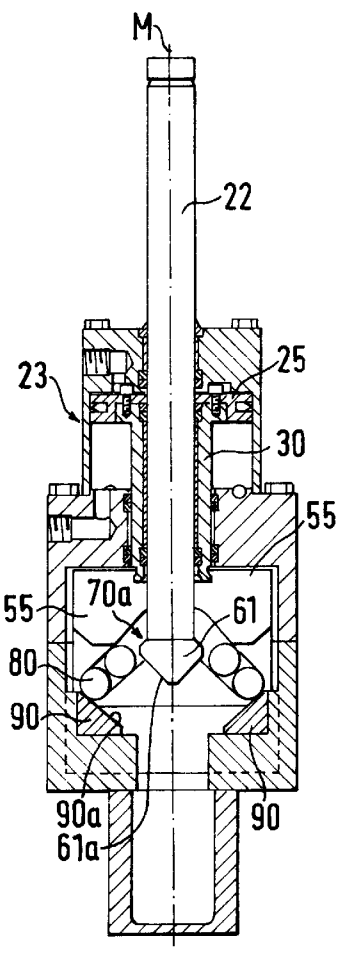
Figure 7A:
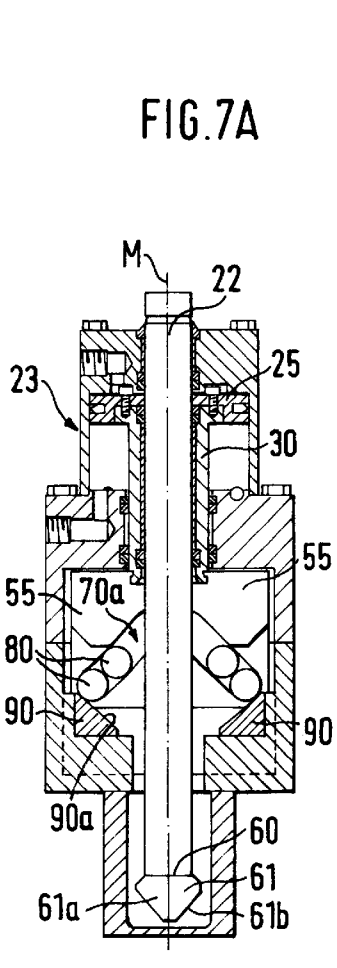

The operation of the inventive lifting device and the function of the force transmission will be described in the following with reference to the FIGS. 7*a* to 7*e* and 8*a* to 8*c*, resp. In the open position of the working station shown in FIGS. 2 and 3 the lower tool member 9 is separated from the upper tool member 8 and the lifting rod 22 is in its lowermost position, whereby it is completely introduced into the power lifting member 20. The piston 25 of the piston-cylinder device 23 is at its upper stop point (FIG. 7*a*). By activating the piston-cylinder devices 12 for the first closing travel the lower tool member 9 is displaced along a first closing travel having a lifting stroke of up to more than 200 mm. Since the lifting rod 22 is connected to the cross-piece 11 and displaceable within the power lifting member 20, the lifting rod 22 is pulled upwards by a distance corresponding to the lifting stroke of the first closing travel and then arrives at a position shown in FIG. 7*b*, whereby the lower tool member 9 and the upper tool member 8 are in the closed state shown in the FIGS. 4 and 5.

After terminating the first lifting stroke having the first closing travel the piston-cylinder device 23 of the power lifting member 20 is activated to thereby initiate the second closing travel. Compressed air is supplied to the piston-cylinder device 23 through the inlet 31. As a consequence, the sleeve 30 pushes the gate-type link 55 downwards with a force $F_1$. The first planes 71*a* and 71*b* formed by the guide grooves transmit the force exerted from the sleeve 30 onto the gate-type link 55 to the pairs of rollers 80. Since the pairs of rollers 80 are each restrictedly guided along the guide grooves 70*a*, 70*b* and a counterforce is exerted thereon by the inclined surfaces 90*a*, 90*b* of the abutment 90, the pairs of rollers 80 both travel upwardly within the guide grooves during the downward movement of the gate-type link 55 and engage the inclined surfaces 61, 61*b* of the thrust member 61 of the lifting rod 22 (FIG. 7*c*). During the further downward movement of the gate-type link 55 the rolls of each pair of rollers roll along the surface of the abutment and the opposite surface of the thrust member, resp., in opposite rotating direction. Since each surface of the abutment 90*a*, 90*b* includes a wedge angle with the corresponding opposite surface of the thrust member 61*a* and 61*b*, the rollers exert a force onto the thrust member 61. Owing to the symmetric arrangement forces act on both surfaces 61*a*, 61*b* of the end piece, whereby the resulting force $F_2$ displaces the thrust member and therefore the lifting rod 22 in upward direction. The components are dimensioned in such a manner that the peak of the end piece is between the pairs of rollers in the lowermost position of the piston 25 (FIG. 7*d*).

The principle of the force transmission from the piston-cylinder device 23 onto the lifting rod 22 through the gate-type link 55 and the pairs of rollers 80 is again represented in the FIGS. 8*a* to 8*c* showing one half of the mechanical transmission device.

The relatively low force $F_1$ exerted by the piston 25 of the piston-cylinder device 23 onto the gate-type link 55 along a relatively long lifting stroke is converted into a relatively high force $F_2$ acting onto the lifting rod 22 with a relatively low lifting stroke thereof. Thus, the force acting onto the lower tool member 9 is higher than the force exerted by the piston-cylinder device 23. Preferably the closing force is between 2 and 30 times as high as the force produced by the driving device. Particularly preferred is a geometrical arrangement producing a closing force which is about 10 times as high as the force produced by the drive of the piston-cylinder device 23. The second closing travel of the lower tool member 9 with respect to the upper tool member 8 is in the order of about 1 mm to about 10 mm. The closing forces which can be produced for the second closing travel are in the range of about 25 kN to 150 kN, dependent on the size and function of the station.

Modifications of the apparatus are possible. The lifting device may comprise one, two or several piston-cylinder devices for the first closing travel. It may also comprise two or several power lifting members for the second closing travel.

According to a further embodiment the lifting device additionally comprises a lever system 100 acting between the movable lower tool member 9 of the station and the machine frame 1, as shown in FIGS. 2 to 5. The lever system 100 serves the purpose of lifting, linked to the movement of the movable lower tool member 9 into the open position thereof, the entire lifting device and thereby moving the formerly fixed upper tool member 8 away from the film sheet 5.

The lever system 100 connects the lower tool member 9 to the base 7 of the working station and to the machine frame 1. The lever system 100 comprises two double levers 101*a*, 101*b*. The fulcrum 102*a*, 102*b* of each lever 101*a*, 101*b* is linked to a point 107*a*, 107*b* of the machine frame 1 through corresponding connecting rods 106*a*, 106*b* which are pivotally supported at the link points 107*a*, 107*b*. The one outer end of each lever 101*a*, 101*b* is pivotally connected to the base 7 through a corresponding pivot joint 103*a*, 103*b*. The other outer end of each lever 101*a*, 101*b* is connected to the cross piece 11 through a corresponding connection rod 104*a*, 104*b*, whereby the link points 105*a*, 105*b* of the connection rods at the cross piece as well as the link points 108*a*, 108*b* of the connection rods at the lever are pivot joints. Thus, the connection rods 104*a*, 104*b* serve the purpose of transmitting the upward or downward movement of the lower tool member 9 to the levers 101*a*, 101*b* and therefore to the base 7.

In operation a downward movement of the lower tool member 9 into an open position of the working station causes a simultaneous upward movement of the base 7 and therefore of the entire lifting device relative to the frame 1. Since the upper tool member 8 is rigidly connected to the base 7, it is lifted relative to the machine frame 1 and therefore relative to the film sheet 5. Hence, packages 6 extending in downward as well as in upward direction can be conveyed without problems.

While the invention has been described in preferred form it is not limited to the precise nature shown as various modifications may be made without departing from the scope and spirit of the invention.

I claim:

1. Lifting device for a working station of a packaging machine, the working station having a first tool member and a second tool member mounted for movement relative to said first tool member, said lifting device comprising a first lifting member for producing a first closing travel of said second tool member towards said first tool member, and a second lifting member for producing a second closing travel following said first closing travel, said second lifting member comprising drive means and mechanical transmission means having means for producing a substantially constant closing force for said second closing travel upon occurrence of a resistance.

2. The lifting device of claim 1, wherein said mechanical transmission means comprises rollers arranged between a first plane surface, a second plane surface and a third plane surface, said first plane surface being linked to said drive means for displacing said first plane surface from a first position into a second position to force said rollers to movably engage said second and third plane surface for increasing the distance therebetween.

3. The lifting device of claim 2, wherein said first plane surface is connected to said drive means, said second plane surface is connected to a base of said working station and said third plane surface is connected to a member linked to said second tool member.

4. The lifting device of claim 3, wherein said drive means comprises a piston-cylinder device and wherein said member linked to said second tool member comprises a lifting rod which is supported in said piston-cylinder device to be reciprocally movable in direction of the lifting stroke.

5. The lifting device of claim 4, wherein said second lifting member comprises a housing, means for connecting said housing to said base of said working station, a gate-type link connected to a piston of said piston-cylinder device and having guide grooves for said rollers, means for supporting said gate-type link to be movable upwards and downwards within said housing, and abutment means for said rollers in said housing.

6. The lifting device of claim 5, wherein said lifting rod has a free end and a thrust member arranged at said free end, said thrust member comprising at least one surface extending obliquely with respect to said lifting direction and defining said third plane surface, said abutment means for said rollers also comprising at least one surface extending obliquely with respect to said lifting direction and defining said second plane surface, both surfaces defining a wedge angle therebetween.

7. The lifting device of claim 6, wherein said guide grooves for said rollers extend substantially perpendicular to said second plane surface defined by said surface of said abutment means, said guide grooves each having an upper edge facing said piston of said piston-cylinder device, said upper edges of two guide grooves for guiding one of said rollers defining said first plane surface.

8. The lifting device of claim 7, wherein said guide grooves, said second plane surface and said third plane surface are arranged such that displacing said gate-type link by means of said drive means causes said rollers to roll between said surface of said abutment means and said surface of said thrust member, means being provided for restrictedly guiding said rollers in said guide grooves of said gate-type link for increasing a distance between said surface of said abutment means and said surface of said thrust member by a force exerted by said rollers onto said thrust member when displacing said gate-type link in a direction opposite to said lifting direction, thereby displacing said lifting rod in said lifting direction.

9. The lifting device of claim 8, wherein said lifting rod extends centrally through said piston and wherein said gate-type link, said abutment means and said lifting rod are symmetric with respect to a cylinder axis of said piston-cylinder device.

10. The lifting device of claim 1, comprising two pairs of rollers.

11. The lifting device of claim 2, wherein a force transmission ratio between a force $F_1$ produced by said drive means and a resulting force $F_2$ exerted onto said second tool member during said second closing travel is defined by the relative angles between said first, second and third plane surfaces.

12. The lifting device of claim 11, wherein said relative angles result in a value of said closing force which is two to thirty times higher than said force $F_1$ produced by said drive means.

13. The lifting device of claim 12, wherein said value of said closing force is about ten times the value of said force produced by said drive means.

14. The lifting device of claim 1, wherein said first closing travel is up to more than 200 mm and the second closing travel is in the range between about 1 mm and about 10 mm.

15. The lifting device of claim 1, wherein said closing force produced by said second lifting member is between about 25 kN and about 150 kN.

16. The lifting device of claim 1, wherein said packaging machine comprises a machine frame and means for conveying a material web along said machine frame through said first tool member and said second tool member, said lifting device further comprising a lever system arranged between said second tool member and said machine frame for coupling said lifting device and said first tool member to said second tool member so that the entire lifting device is lifted and therefore the first tool member is moved away from said material web when said second tool member is moved into an open position.

17. Packaging machine comprising a machine frame and a working station mounted thereon, the working station having a first tool member, a second tool member mounted for movement relative to said first tool member and a lifting device for moving said second tool member, said lifting device comprising a first lifting member for producing a first closing travel of said second tool member towards said first tool member and a second lifting member for producing a second closing travel following said first closing travel, said second lifting member comprising drive means and mechanical transmission means having means for producing a substantially constant closing force for said second closing travel upon occurrence of a resistance.

18. The packaging machine of claim 17, wherein said mechanical transmission means comprises rollers arranged between a first plane surface, a second plane surface which is substantially perpendicular to the first plane surface, and a third plane surface including a wedge angle with said second plane surface, said drive means being coupled to said first plane surface to displace said first plane surface to thereby urge the rollers to move along said second and third plane surface, thereby urging said third plane surface away from said second plane surface.

* * * * *